US009248557B2

(12) United States Patent
Hartman

(10) Patent No.: US 9,248,557 B2
(45) Date of Patent: Feb. 2, 2016

(54) INSTALLATION TOOL

(75) Inventor: Aharon Hartman, Lakewood, NJ (US)

(73) Assignee: Moshe Koot, Lakewood, NJ (US)

( * ) Notice: Subject to any disclaimer, the term of this patent is extended or adjusted under 35 U.S.C. 154(b) by 250 days.

(21) Appl. No.: 13/568,990

(22) Filed: Aug. 7, 2012

(65) Prior Publication Data

US 2013/0167693 A1 Jul. 4, 2013

Related U.S. Application Data

(63) Continuation-in-part of application No. 13/454,807, filed on Apr. 24, 2012, now abandoned.

(60) Provisional application No. 61/478,530, filed on Apr. 24, 2011, provisional application No. 61/659,406, filed on Jun. 13, 2012.

(51) Int. Cl.

| | |
|---|---|
| ***B25B 15/02*** | (2006.01) |
| ***B25B 15/00*** | (2006.01) |
| ***B25B 31/00*** | (2006.01) |

(52) U.S. Cl.

CPC ..... *B25B 15/02* (2013.01); *B25B 15/007* (2013.01); *B25B 31/00* (2013.01)

(58) Field of Classification Search

CPC ..... B25B 23/005; B25B 23/02; B25B 23/08; B25B 23/10; B25B 23/101; B25B 23/106; B25B 15/00; B25B 15/007; B25B 15/02; B25B 31/00

USPC ..... 81/451–453, 456–458

See application file for complete search history.

(56) References Cited

U.S. PATENT DOCUMENTS

| | | | | | |
|---|---|---|---|---|---|
| 1,645,753 | A | * | 10/1927 | Hanson | 81/457 |
| 2,273,861 | A | * | 2/1942 | Green | 81/457 |
| RE23,201 | E | * | 2/1950 | Price | 81/451 |
| 2,620,000 | A | * | 12/1952 | Noffsinger | 81/457 |
| 3,244,208 | A | * | 4/1966 | McKenzie | 81/453 |
| 5,791,207 | A | * | 8/1998 | Ahdoot | 81/452 |

* cited by examiner

*Primary Examiner* — Hadi Shakeri

(74) *Attorney, Agent, or Firm* — Israel Nissenbaum; Yitzy Nissenbaum

(57) ABSTRACT

A one handed operable tool configured for the positioning and fixed installation of fastening elements in space restricted areas and particularly anchoring clips for kitchen sinks. The tool comprises manipulable elements for securely holding a fixture or fastener, and aligning the fixture or fastener with previously installed elements and driving elements in proper orientation for effecting a secure properly positioned connection between a fixture or fastener with the previously installed elements.

3 Claims, 8 Drawing Sheets

INSTALLATION TOOL

FIELD OF THE INVENTION

This invention relates to mechanical hand tools and particularly to hand tools used for installation of odd shaped fasteners, in space-limited access areas, used to fix items such as kitchen sinks into position.

BACKGROUND OF THE INVENTION

Typically, installation tools such as screwdrivers, hammers and other drivers, generally require a two hand operation when they are used with non-fixed position items such as loose screws, bolts, nails and the like. A first hand is used for stabilizing the item to be installed and the other hand is needed to operate the appropriate tool.

Specialty tools such as screwdriver type devices have often embodied holding elements such as integral magnetic elements or screw head grippers, designed to hold screws in place during installation. These tools are however very limited in useful applicability and ability to hold fastening and anchoring elements in fixed position and proper orientation of odd shaped fastening and anchoring elements, under restricted conditions of installation and use, other than a basic placement. In addition, these tools provide a limited manner of release of held elements, once they are fixed into position, and sometime require use of a second hand.

Plumbing installation procedures, which require the use of clips, anchors, connectors and the like, usually of odd shape (not operably amenable to being held by standard drivers and holders and existing driver tools), cannot be efficiently effected with existing tools. This inefficiency is additionally exacerbated by the usual requirements of plumbing procedures with the need for exact alignment in blind or non-visible environments, which provide additional challenges.

Plumbing procedures are thus usually awkward and possibly impeded in the first instance, and more so when procedures such as installations take place in typical areas wherein access is severely restricted, such as in narrow areas under a cabinet-enclosed sink. Operation visibility is, at best, minimal and many installations of plumbing fixtures invariably require touching determinations of orientation for exact connections. The touching also often requires follow through guiding of fixtures and installation equipment as well as close alignment of parts and this often results in the untenable need of an extra pair of hands. It is also often the case that installations of fixtures and sinks is only partially effected, with installations in difficult to install areas not being properly made.

SUMMARY OF THE INVENTION

It is an object of the present invention to provide a fastener installation tool suitable for one handed operation in confined areas such as for installation of fasteners for plumbing fixtures, leaving a hand free for other operations or the other hand not being needed in space restricted areas;

It is a further object of the present invention to provide such tool with stabilizing elements for releasably holding odd shaped plumbing fasteners in a fixed and locked proper position while placing them and anchoring them, especially fasteners of non-uniform or odd-shaped configurations requiring both integration of separate elements and fixed fastening placement of the integrated fastener onto an anchoring substrate.

It is another object of the present invention to provide the tool with visible indicia of odd shaped fastener orientation for proper placement and for elements to maintain the proper orientation throughout the installation procedure.

It is still another object of the present invention to provide the tool with a retractable drive element suitable for effective use with a single hand and under conditions of little or no visibility.

It is yet another object of the present invention to provide the tool with one handed retraction and engagement and disengagement controls. for release of a fastener, when installation is completed.

Generally the present invention comprises a one handed operable tool configured for the positioning and fixed installation of fastening elements, requiring properly oriented positioning and installation, under conditions of minimal space and visibility and particularly clips used as anchoring elements in kitchen sink installations. The tool comprises:

i) a holding and locking mechanism for releasably holding a fastening element in a fixed position suitable for installation;

ii) a driving element configured for use with one hand to operatively engage and drive the fastening element into an installed position, while the fastening element is in the fixed position suitable for installation;

iii) an orientation indicator configured to indicate initial proper orientation positioning of the fastening element, as held by the tool, for installation;

iv) an orientation element configured to maintain proper orientation of the fastening element during installation; and v) a one handed operable mechanism for releasing the holding and locking mechanism to release the fastening element after the installation thereof.

The tool preferably comprises a narrow elongated structure, suitable for use in minimal space areas, and a manipulable locking element configured for securely and fixedly holding an odd shaped anchoring fixture or fastener, requiring proper orientation, during installation with a one handed releasable locking disengagement. The tool further comprises an aligning and engaging element for aligning and engaging the fixture or fastener in a proper orientation, with previously installed elements and fixtures. The tool is further integrated with a driving element configured for driving engagement thereafter with the anchoring fixture or fastener to effect a secure properly positioned connection between the anchoring fixture or fastener with the previously installed elements and fixtures, after the anchoring fixture or fastener is brought into an installation position and while being securely held by the tool. The tool further comprises disengagement means configured for one handed releasing or disengaging of the tool from the anchoring fixture or fastener after driving engagement has been effected.

These and other objects, features and advantages of the present invention will become more evident from the following discussion and drawings in which:

SHORT DESCRIPTION OF THE DRAWINGS

DETAILED DESCRIPTION OF THE INVENTION AND DRAWINGS

Figure 1A:
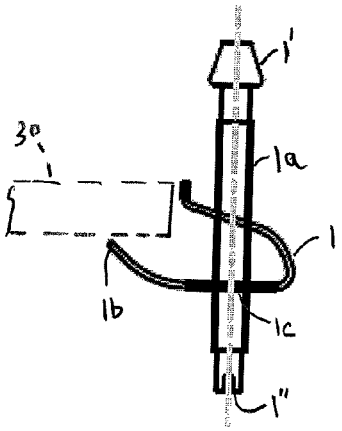
FIG 1A PRIOR ART
FIGS. 1A and 1B are side and front views of a standard prior art spring clip with separable bolt-like element configured for anchored placement into a baseboard channel for holding a sink in position.
Figure 1B:
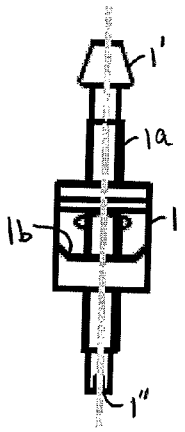
FIG 1B PRIOR ART

Kitchen sinks are generally installed in cutouts in cabinets, with fasteners or anchors such as the clip 1 shown in FIGS. 1A and 1B being used to fasten the sink to the surrounding lip of the cutout to prevent dislodgment and movement. The sinks are standardly provided with separated peripheral channels with open bottom slots for engagement with the heads 1' of bolt-like member 1*a*, which is threadingly fastened to clip 1 in aperture 1*c* of the clip 1. The bolt-like member or connector 1*a* extends through the open bottom slot to permit driving engagement with a driver such as a screwdriver.

Figure 7:
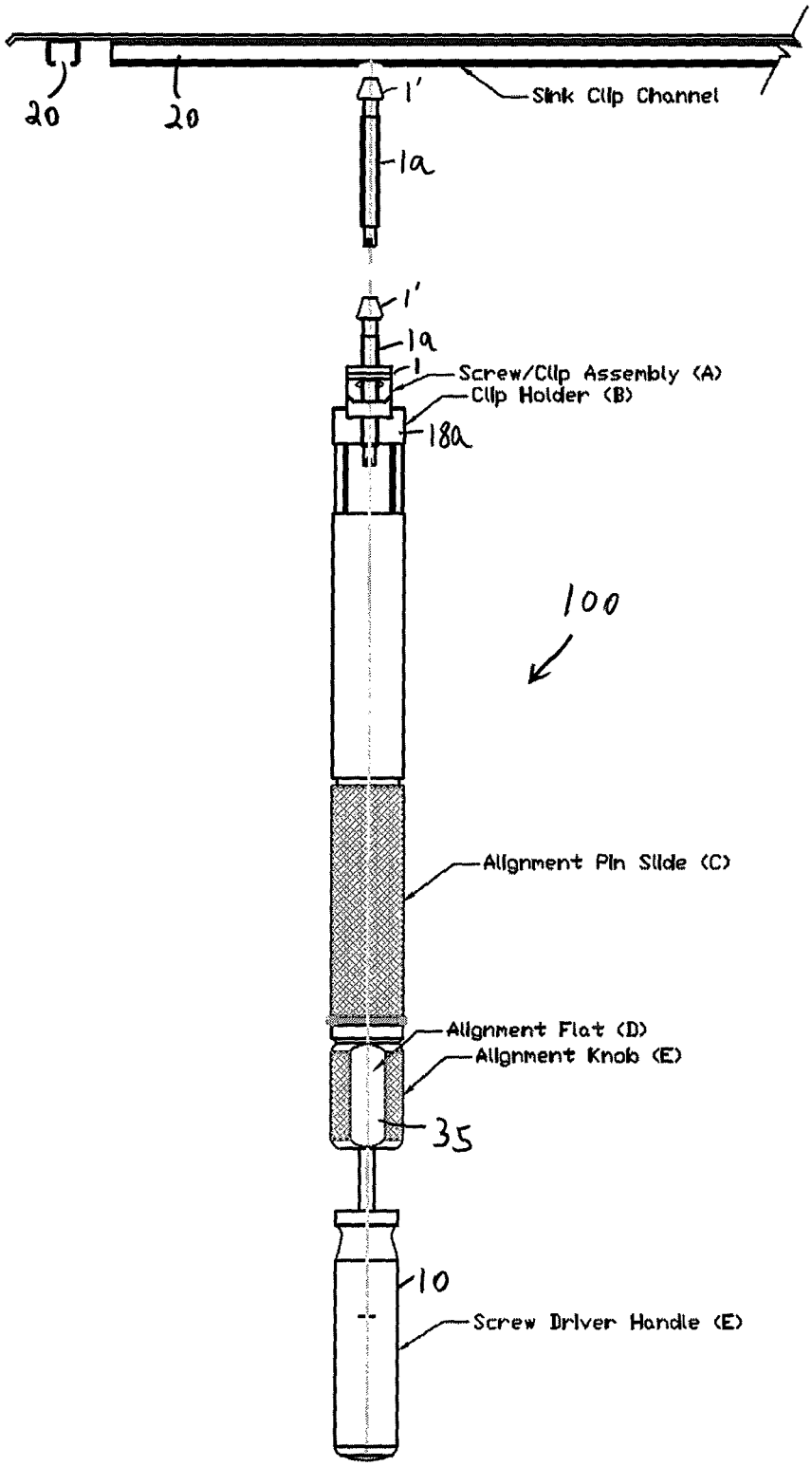
FIG. 7 is a front view of the aligned engagement of the bolt-like element into a sink channel, as being carried and positioned by the tool of FIG. 5.

The clip 1 must be placed with an orientation such that when fully installed, the extending end 1*b* tightly engages the underside of the peripheral edge 30 (shown in dashed lines). Multiple clips are used around the four sides of a sink to securely hold it in a cabinet cutout. However, the space between the front of a sink and a cabinet front is usually very restricted in area and the fasteners are very difficult to install in this area. Often installers actually omit the placement of the front fasteners and rely on the side and rear holding alone. This is however an incomplete installation especially since it is the front of the sink which is most exposed and most susceptible to dislodgement The clip 1 is provided with aligned apertures through which a bolt-like threaded member 1*a* is positioned, with the lower aperture being threading engaged with the threaded member 1*a*. The head 1' of the threaded member 1*a* is solid and configured to slidingly snugly fit into a channel 20 (shown in FIGS. 7-9), integrated with the periphery of a standard kitchen sink (four open channels 20 are positioned on the four peripheral sides of the sink, not shown). The bottom of the threaded member 1*a* is provided with a slot 1" configured for engagement with a screw driver whereby tightening of the threaded member 1*a* with the engaging aperture 1*c* causes the extended front end of the spring clip 1*b* to threadingly rise into tight engagement with a lip 30 of the cabinet cutout (shown in dotted line in FIGS. 1A and 9). In an installation procedure, several clips are installed in each of the four channels (the left and front channels are shown in FIGS. 7 and 9) and tightened to hold the sink in position.

However, the process of installation of such clips on the front side of the sink is severely restricted by the approximately one to one and a half inch usual clearance space between the front of the sink and the kitchen cabinet into which the sink is normally installed. Only one hand is normally physically able to be used in such restricted area, if at all, and the tool portion, inserted between the cabinet and the sink, itself should preferably be less than an inch in width.

Figure 2:
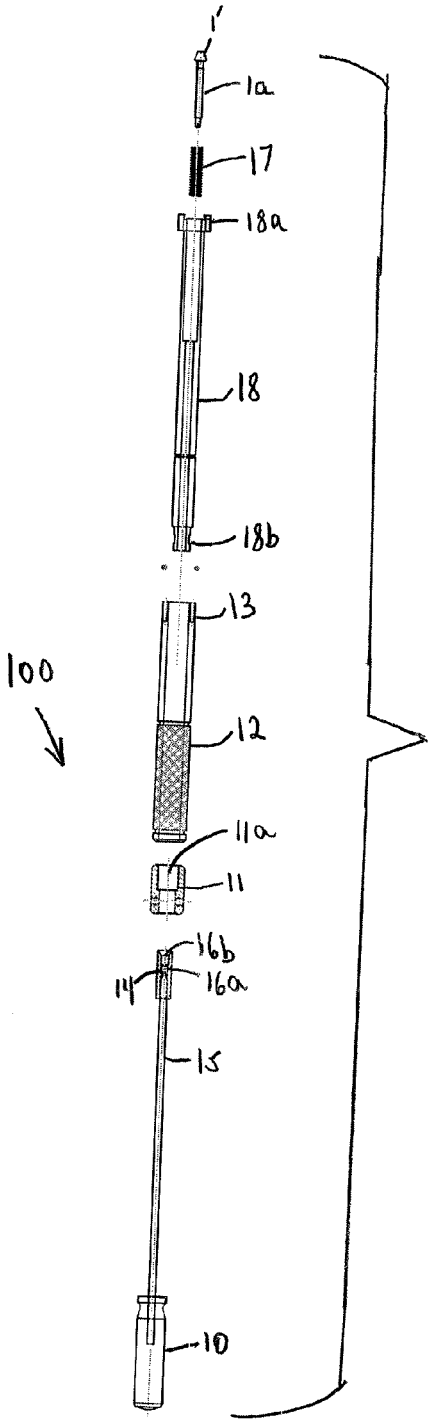
FIG. 2 is an exploded view of an embodiment of the one handed operable installation tool of the present invention with partial cross sections for clarity.
Figure 6:
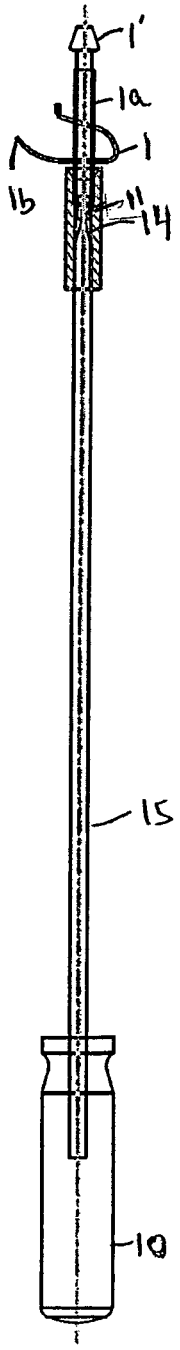
FIG. 6 is a view of the driving mechanism of the tool, apart from the rest of the tool, as engaged with the spring clip.

In the exploded view of FIG. 2, an embodiment of the tool 100 of the present invention is shown with nesting operating elements in an elongated, narrow width structure suitable for use in the limited available area of use. Tool handle 10 is integrated with a flat head screwdriver element 15, which, in turn, is integrated with bolt guide 16 for accommodation of bolt member 1*a* in seat 16*a*. The integration ensures that the blade 14 of the driver 15 is properly aligned with the notch 1" of threaded bolt member 1*a* for torqued compression and locking of clip 1, as shown in FIGS. 6 and 9.

Figure 3:
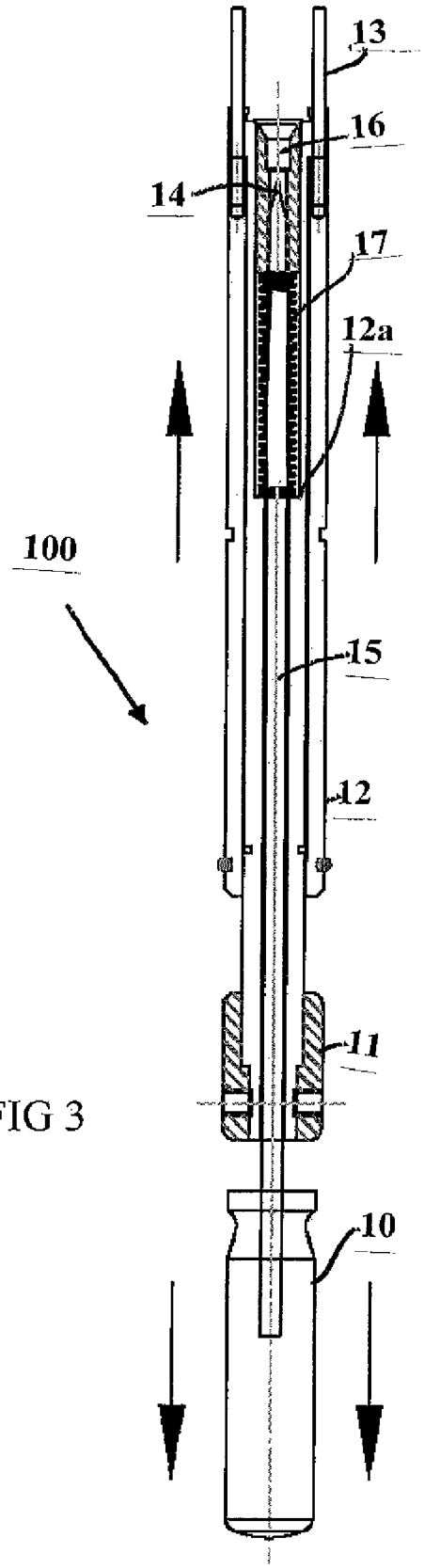
FIG. 3 is a cross section view of the assembled tool of FIG. 2, with arrows showing operative up and down movement of operative components.

Alignment knob 11 is fitted over driver 15 in a relative circumferential position, with cavity 11*a* being sized to snugly hold the lower end 18*b* of elongated clip holder 18 with clip holding end 18*a*, which, in turn, circumferentially encloses driver 15. Spring element 17 has an upper end tensioned against bolt guide 16 and a lower end tensioned against ledge 12*a* of alignment pin slide 12 to provide pressure against the base of clip 1, inserted in clip holder 18 as shown in FIGS. 3, 5, and 9.

Figure 4:
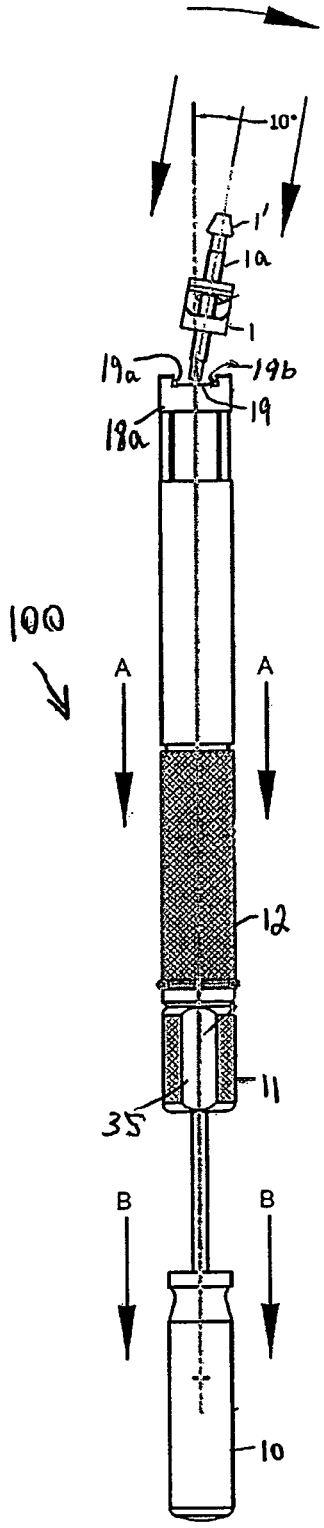
FIG. 4 is the tool of FIG. 3, with retracted orientation alignment pins and showing angled placement of the spring clip of FIGS. 1A and 1B into a locking seat.

The clip holding end 18*a* of the clip holder 18 is provided with a supporting base 19, for support of the base of clip 1 during installation. Supporting base 19 has a width dimension closely conformed to that of the width of the base of clip 1 but with sufficient room for an offset insertion as shown in FIG. 4. Undercut regions 19*a* and 19*b* at the opposite ends of the base 19, in conjunction with the tensioned pressure exerted thereon by spring 17, serve to hold the clip 1 in a positive locked position during the installation. As shown in FIG. 4, alignment pins 13, shown in FIG. 3, are retracted out of the way by pulling down of alignment pin slide 12. This permits clip 1 to be positioned by an offset insertion of the clip into the clip holder by inserting a side of the clip 1 into the clip holder 18 at about a 10° offset angle from vertical under one of the undercut regions 19*a* or 19*b*. Swiveling the clip 1 into the vertical position causes the other side to be positioned under the other undercut region. Upward tension pressure by spring 17 serves to lock the clip against the undercut overhangs. After the clip 1 is locked into position on the tool 100, as shown in FIG. 5, the clip is installed.

Figure 5:
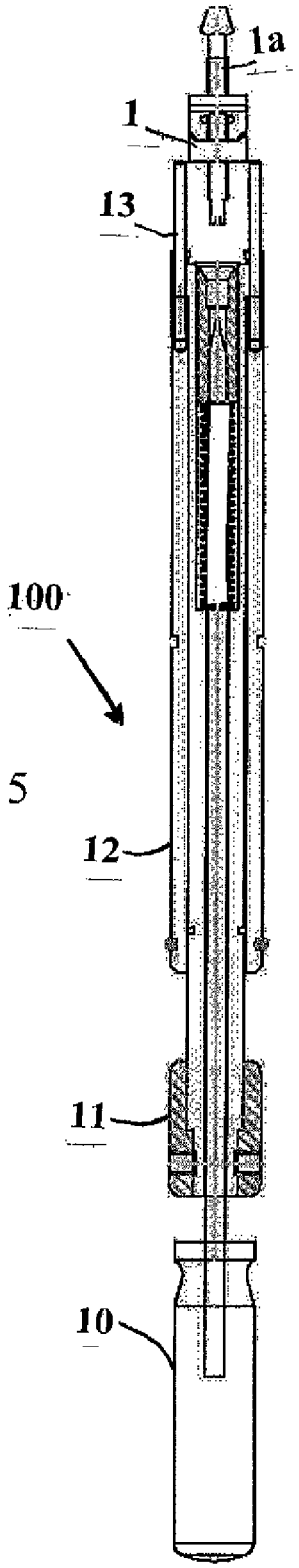
FIG. 5 shows the engaged tool with locked in position spring clip and with retraction of the handle to engage the driver with the bolt-like element of the spring clip.

The entire installation procedure from the initial setting of the clip into the tool and fixedly installing the clip into the sink channel and removal of the tool from the clip entails the following procedure:

1) initially, the alignment pin slide 12 is pulled down to the bottom of its travel;
2) the handle 10, spring loaded with resistance by spring 17, is pulled down to the bottom of its travel and held in this position;
3) the clip 1, with threadingly engaged bolt 1*a*, is loaded, with the angled offset insertion, and then vertical positioning as shown in FIGS. 4 and 5;
4) handle 10 is then gently released to cause the spring 17 to exert pressure against the loaded clip and bolt assembly to lock it into position and wherein the blade 14 of driver 15 is engaged in slot 1" of the bolt 1*a*, as shown in FIG. 6.

Figure 8:
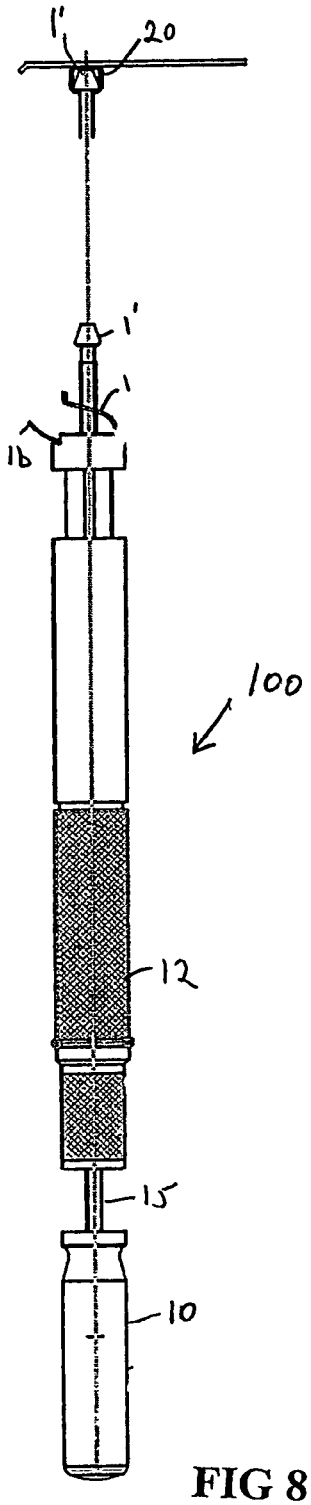
FIG. 8 is a side view of the bolt-like element being positioned for placement into the sink channel and crosswise setting of the spring clip.
Figure 9:
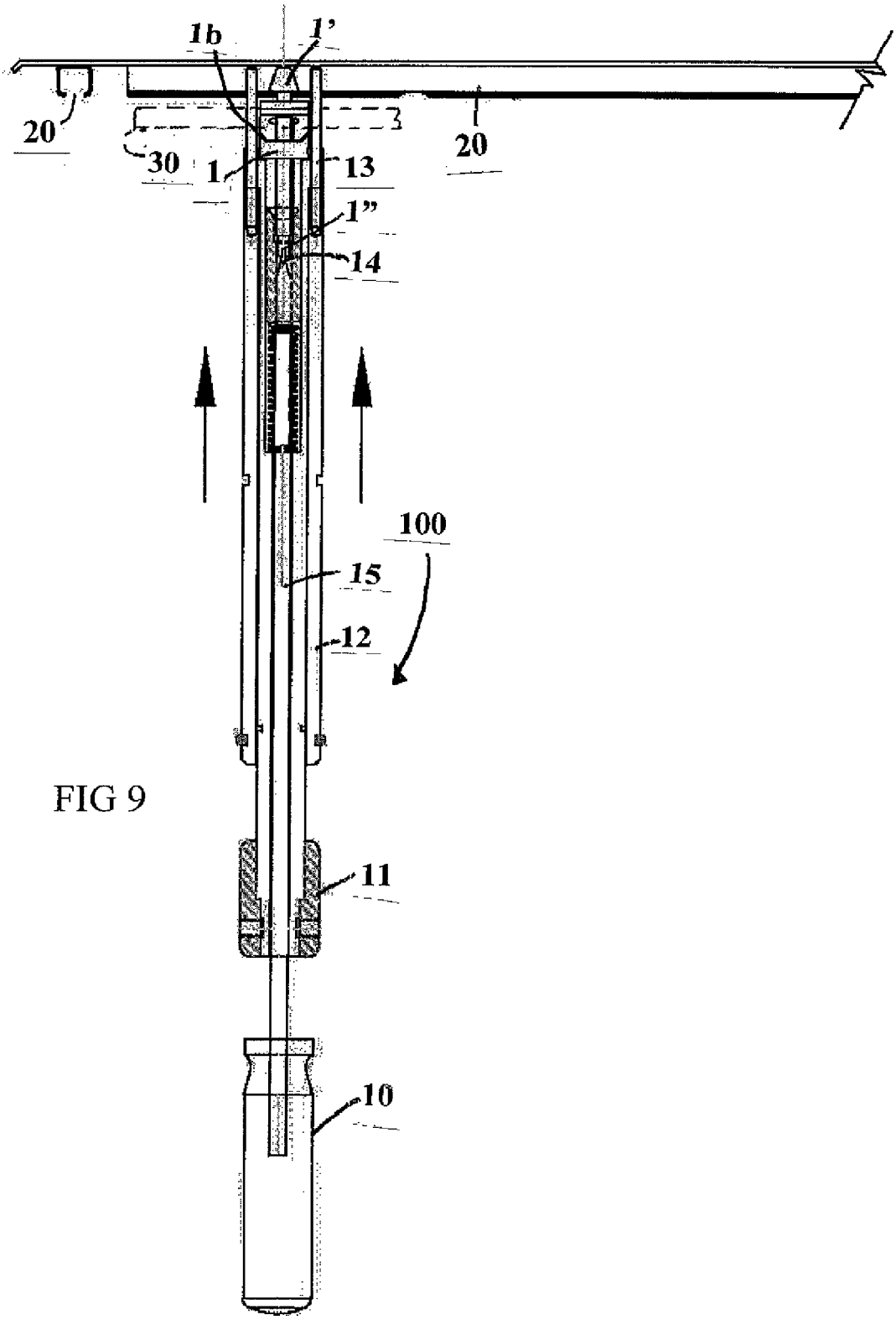
FIG. 9 is a front view of the tool with placement of the boltlike-element in the sink channel with lateral alignment pins upwardly extended for locking holding of the spring clip.

The above procedures are carried out as a fastener "loading", apart from the actual installation in a restricted space area, and are effected with two hands. Thereafter, the tool, with locked-in-place fastener clip is used to install the fastener clip as follows:

5) tool 100, with locked in clip 1, is handled by handle 10 with one hand and the bolt head 1' is guided into a sink clip channel 20, as shown in FIGS. 7-9;

6) tool 100, with locked in clip 1, is then rotated by handle 10 so that, as shown in FIG. 7, indicia 35, as a visible flat section, faces forward (parallel to the sink channel 20 direction), to indicate that orientation of clip 1 engaging portion 1*b* is engagingly positioned in place below the peripheral lip 30 of the sink cut out (shown in dashed lines in FIG. 9);

7) alignment pin slide 12 is then moved up to engage guide pins 13 into channel 20;

8) handle 10 is then rotated with one hand (out of the space restricted area between the sink and the cabinet front). The guide pins 13 keep the clip 1 in the correct orientation by preventing rotation of the clip as the handle 10 is rotated with one hand to drive threaded engagement of bolt 1*a* in the clip aperture to tighten the clip end 1*b* against peripheral lip 30;

9) handle 10 is pulled to the bottom of its travel to disengage blade 14 of driver 15 out of bolt slot 1" and to compress spring 17 from exerting holding pressure and the tool is swiveled either right or left, to release the clip 1 from the clip holder;

10) the above steps are repeated with additional fastener clips, as desired or needed until the installation is complete.

It is understood that the above description and examples of specific embodiments are only illustrative of the present invention and that changes may be made in structure and elements as well as procedure of use without departing from the scope of the present invention as defined in the following claims.

What is claimed is:

1. A one handed operable tool configured for the positioning and fixed installation of two piece fastening elements with each fastening element being comprised of a fastening member and a drive member, the drive member being movably engaged within the fastening member and configured to compress the fastening member into a fastening position, the fastening member requiring properly laterally oriented positioning and installation, wherein the tool comprises:

i) a holding and locking mechanism configured for holding the fastening member in a fixed position suitable for the fixed installation and configured for releasing the fastening member from the tool after the fixed installation, with a one handed operation;

ii) a driving element configured for use with one hand to operatively engage and drive the drive member to compress the fastening member into an installed position, while the fastening member is in the fixed position suitable for installation;

iii) an orientation element configured to maintain proper lateral orientation of the fastening member during installation; and wherein the fastening member comprises a clip element, with the drive member comprising a bolt connector with the holding and locking mechanism of tool being configured with undercut elements adapted to hold the clip element in a locked fixed orientation with an undercut holding engagement between the clip element and the tool while the bolt connector is driven by the drive member to compress the clip element, the clip element having a portion configured for connection with a sink placed in a cabinet cutout, wherein the clip element and bolt connector are configured to fix the sink into position relative to the cabinet cutout, the clip element comprising: an aperture for threaded connection with the bolt connector and an end configured for locking engagement with an underside of a periphery of the cabinet cutout, with threaded movement of the bolt connector in the aperture effecting the compression with fixed engagement of the clip member with the underside of the periphery of the cabinet cutout and wherein, when the fixed engagement is completed, the holding and locking mechanism of the tool is configured to be disengaged from the clip member with a release of the clip member from the undercut elements and the bolt connector from the tool with the one hand operation.

2. The one handed operable tool of claim 1, wherein the tool comprises an orientation indicator configured to indicate initial proper lateral orientation positioning of the clip element, as held by the tool, for installation.

3. The one handed operable tool of claim 1, wherein the bolt connector comprises a drive slot and wherein the driving element of the tool comprises a rotatable blade element configured for driving engagement with the drive slot, wherein one handed rotation of the driving element effects rotation of the bolt connector and threaded movement of the bolt connector in the clip aperture to compress and force the locking engagement of the end of the clip with the underside of the periphery of the cabinet cutout, to provide the fixed installation of the sink in the cabinet cutout.

* * * * *